US012460626B2

(12) United States Patent
Timmer

(10) Patent No.: US 12,460,626 B2
(45) Date of Patent: Nov. 4, 2025

(54) DOUBLE MEMBRANE PUMP

(71) Applicant: Timmer GmbH, Neuenkirchen (DE)

(72) Inventor: Herbert Timmer, Neuenkirchen (DE)

(73) Assignee: Timmer GmbH, Neuenkirchen (DE)

( * ) Notice: Subject to any disclaimer, the term of this patent is extended or adjusted under 35 U.S.C. 154(b) by 0 days.

(21) Appl. No.: 18/635,512

(22) Filed: Apr. 15, 2024

(65) Prior Publication Data

US 2024/0344509 A1 Oct. 17, 2024

(30) Foreign Application Priority Data

Apr. 17, 2023 (DE) ..... 102023109604
Mar. 7, 2024 (EP) ..... 24161947

(51) Int. Cl.

| | |
|---|---|
| ***F04B 43/02*** | (2006.01) |
| ***F04B 43/04*** | (2006.01) |
| ***F04B 43/073*** | (2006.01) |
| ***F04B 53/14*** | (2006.01) |

(52) U.S. Cl.
CPC ..... *F04B 43/026* (2013.01); *F04B 43/04* (2013.01); *F04B 53/146* (2013.01); *F04B 43/0736* (2013.01)

(58) Field of Classification Search
CPC ..... F04B 9/04; F04B 9/047; F04B 43/025; F04B 43/026; F04B 43/04; F04B 43/0736; F04B 53/146
See application file for complete search history.

(56) References Cited

U.S. PATENT DOCUMENTS 2,508,253 A 5/1950 Haggardt
2021/0301809 A1* 9/2021 Hines ..... F04B 17/03

FOREIGN PATENT DOCUMENTS

DE 202004020335 U1 * 5/2005 ..... F04B 43/026
DE 102020112114 A1 11/2020
GB 572502 A 10/1945
WO 2021202689 A1 10/2021

OTHER PUBLICATIONS

Deutsches Patent—Und Markenamt (German Patent and Trademark Office), Recherchebericht (search in a corresponding application), Jan. 11, 2024.

* cited by examiner

*Primary Examiner* — Audrey B. Walter
(74) *Attorney, Agent, or Firm* — Laurence P. Colton; Smith Tempel Blaha LLC

(57) ABSTRACT

A double membrane pump having a casing and a piston rod movably received in the casing, the casing having at least one inlet opening and at least one outlet opening, and a first membrane is arranged at one end of the piston rod and a second membrane is arranged at the other end of the piston rod. The first membrane is arranged in a first chamber of the double membrane pump and the second membrane is arranged in a second chamber. The membranes are designed to separate the chambers into a product chamber and an expansion chamber respectively. The pump has a drive device for bringing about a translational movement of the piston rod. The double membrane pump has a piston rod which is designed to perform a self-regulated, oscillating movement and thus enables simplified control of the membranes.

26 Claims, 5 Drawing Sheets

DOUBLE MEMBRANE PUMP

CROSS REFERENCE TO RELATED APPLICATIONS

This application claims priority on and the benefit of European patent application number 24161947.7 having a filing date of 7 Mar. 2024 and German patent application number 102023109604.4 having a filing date of 17 Apr. 2023.

BACKGROUND OF THE INVENTION

Technical Field

The invention relates to double membrane pumps having a casing and a piston rod received in the casing for translational movement along a longitudinal axis of the casing.

Prior Art

Such double membrane pumps, which are used in particular for conveying and dosing liquid media, such as chemicals, solvents, paints, lacquers and many more, are known in principle.

The pumping takes place with the help of a piston rod arranged movably in the double membrane pump, which causes an oscillating translational movement of membranes arranged at its ends by a translational movement of the piston rod. Each of the membranes is assigned to a chamber of the double membrane pump, whereby the chamber is formed into two separate chamber sections by means of the membrane. In a pneumatically driven double membrane pump, compressed air is present in one of the chamber sections and the medium to be pumped is located in the other chamber section. In mechanically driven double membrane pumps, the membrane can be coupled to a piston rod moving back and forth, which transmits the back and forth movement to the membranes and thus realises the pump strokes. Double membrane pumps are characterized by the fact that, compared to membrane pumps with only one membrane, an improved and more even volume flow of the medium to be pumped can be achieved.

A generic double membrane pump is known from the publication WO 2021/202689 A1, which realizes a conversion of the rotational movement of the pump drive into a translational movement of the piston rod with the aid of a rotationally mounted hollow cylinder, which is designed to encompass the piston rod. The piston rod is designed in the form of a spindle, whereby the oscillating movement of the membranes is achieved by sensing the end positions and complex control of a reversal in the direction of rotation of the spindle. This achieves the oscillating movement of the piston rod and thus the membranes and generates a defined deceleration and acceleration ramp. The disadvantage of this double membrane pump is that the motor has to be switched over to change the direction of rotation of the spindle. This requires a considerable amount of energy.

A piston pump with a camshaft mechanism is known from GB 572 502 A. The reciprocating movement is caused by the interaction of two elements. The conversion of the rotary movement into a linear movement is achieved by using a reversing spindle (inversing spindle). However, a reversing spindle is unsuitable for a membrane pump or double membrane pump, as a reversing spindle cannot realize the short stroke movements required for a membrane pump, or at least only poorly. Furthermore, the forces required to drive a membrane in the axial direction can only be absorbed poorly and, above all, not with long-term functional reliability.

U.S. Pat. No. 2,508,253 A discloses a compressor in which a compressor cylinder and its piston are mounted axially in an electric drive motor. The rotor of the motor and the compressor piston are coupled to each other in such a way that the compressor piston performs a back and forth movement when the rotor rotates. In order to move the piston back and forth when the rotor rotates, it has a helical groove on its circumference. A ball element mounted in a sleeve of the rotor engages in said groove. When the rotor turns, this rotary movement is converted into a linear movement of the piston, but the ball guided in the sleeve generates a point load that causes a tilting moment and thus an uneven load distribution. The uneven load distribution in turn causes additional friction and additional wear, which has a negative effect on the service life of the overall system. Another disadvantage is that the compression cylinder and the piston inside it have relatively small diameters compared to a membrane pump. The pressure achieved by the piston is therefore relatively low and unsuitable for transmitting high axial forces.

DE 10 2020 112 114 A1 discloses a mechanism for converting a rotational movement into a translational linear movement. A pair of symmetrically arranged ball bearings with curved grooves is used for this purpose. These enable the reciprocal conversion between rotational movement and linear movement of the two elements relative to each other: When the inner part rotates, the outer part performs a linear movement and, conversely, the inner part performs a linear movement when the outer part rotates. The disadvantage of this is that the guiding groove of the ball drive can only absorb axial forces in one direction. The drive is therefore unsuitable for generating an oscillating movement. Furthermore, due to the small number of balls, the guiding groove guide described is only insufficiently suitable for transmitting forces acting in an axial direction. In addition, the guiding groove guide described requires a considerable installation space in the axial direction due to the system and prevents a compact design of the drive.

BRIEF SUMMARY OF THE INVENTION

The problem of the invention is to eliminate the disadvantages described and to provide a double membrane pump which is characterized by a compact design and simplified control of its membranes.

This problem is solved by a double membrane pump that comprises:

- a casing and a piston rod received in the casing for translational movement along a longitudinal axis of the casing,
- wherein the casing has at least one inlet opening and at least one outlet opening, and
- wherein a first membrane of the double membrane pump is arranged at a first bar end of the piston rod and a second membrane of the double membrane pump is arranged at a second bar end of the piston rod facing away from the first bar end,
- wherein the first membrane is arranged in a first chamber of the double membrane pump formed in the casing and the second membrane is arranged in a second chamber formed in the casing,
- wherein the membranes are designed to separate the chambers into a product chamber and an expansion chamber respectively, and with a drive device for bringing about a translational movement of the piston rod.

A membrane pump is characterized by the fact that the fluid is moved over a large area. Alternatively, it can be assumed that the membrane in a double membrane pump corresponds to a piston that has a disproportionately large piston area but only makes short stroke movements. Since the pressure realized by a pump is derived from the force per surface area, large axial forces result with large piston or membrane surfaces.

According to the invention, the piston rod has means which are designed to perform a self-regulated, oscillating movement. Or, in other words, the movement of the piston rod is a self-regulated, oscillating movement of the piston rod. This means that the oscillating movement of the piston rod is brought about by its structure and is therefore self-regulated. No additional measure or additional means is required to bring about the oscillating movement, which has so-called turning points.

In one embodiment of the double membrane pump according to the invention, the piston rod is divided and the self-regulated, oscillating movement of the piston rod is realized with the aid of at least two guiding grooves which are designed independently of one another, one guiding groove being designed to move the first membrane and the other of the guiding grooves being designed to move the second membrane.

The split piston rod comprises a first and a second piston rod section, each with the same center axis. The first piston rod section is coupled to the first membrane and the second piston rod section is coupled to the second membrane. The two piston rod sections are located between the two membranes, analogous to the continuous piston rod, but are arranged at a distance from each other. Put simply, the interrupted piston rod corresponds to a non-interrupted piston rod divided into two halves with a gap between the two parts. The gap, which is preferably arranged in the center of the piston rod, forms a free space that decouples the stroke movements of the two piston rod sections from each other or makes them independent of each other.

While it is not possible to superimpose the pumping strokes of the two membranes in the case of a continuous piston rod, the guiding groove guides can also be symmetrical or mirror-symmetrical in the case of a split piston rod. In this case, the gap, i.e. the distance between the two piston rod sections, is not constant during a pump-suction cycle, but varies. For example, while one piston rod section is still moving to the right, the switchover time may already have been reached for the other piston rod section and the movement is reversed.

As a result, a piston rod divided into two piston rod sections makes it particularly easy to realize a guiding groove guide with superimposed pump strokes.

The advantage is that independent movements of the membranes and thus the suction and pumping strokes can be easily realized by means of the guiding groove guide. The guiding grooves in the piston rod are designed in such a way that there is no need for complex control of the direction of rotation of the drive device.

A guiding groove guide is a guide that transmits the movement of a component to another component by forcibly changing the direction of movement. In the present case, the guiding groove guide is used to transfer a rotational movement of a motor to a rod in the form of a translational back and forth movement.

In this respect, the motor provided in the present case comprises a hollow cylinder and a piston rod arranged in the hollow cylinder. The hollow cylinder and piston rod together form a clearance fit and are coupled to each other via a guiding groove guide in such a way that the rotational movement of the hollow cylinder is converted into a translational back and forth movement of the piston rod.

For example, a pin can be provided on the outer lateral sheath surface of the shaft, which engages in a non-linear and groove-like guide track (guiding groove) provided in the inner lateral sheath surface of the hollow cylinder. When the hollow cylinder rotates, the pin, and thus the shaft as a whole, is displaced linearly. As an alternative to a pin projecting from the shaft into a groove-like guide track of the hollow cylinder, the pin can also be provided on the inner lateral sheath surface of the hollow cylinder and engage in a non-linear, groove-like guide track (guiding groove) provided in the outer lateral sheath surface of the shaft. Depending on the respective application, the pitch and course of the guiding groove guide can also be designed differently. In this respect, for example, it can be provided that during a pump-suction cycle the movements of the two membranes take place differently, preferably also temporarily in opposite directions.

In the membrane pump according to the invention, the piston rod is not designed as a spindle. One advantage is therefore that the direction of rotation of the spindle does not have to be reversed, as in the prior art.

At this point, it should be mentioned that the guiding groove guide has at least one guiding groove associated with the first membrane and the further guiding groove associated with the second membrane. Similarly, two or three or more guiding grooves could also be formed to move a membrane. In principle, the same number of guiding grooves are preferably assigned to each membrane.

To realize a compact double membrane pump, the drive device is designed to bring about the translational movement of the piston rod, which has a rotor that is coaxial with the piston rod. In this way, the required translational movement can be brought about in a simple manner with the aid of a rotational movement.

In particular, the drive device is an electric drive device. A compact design is important because, for example, when used as a pump for paint supplies in a paint shop or in printing machines, the installation space is always limited and protruding designs can then only be accommodated with difficulty or not at all. A compact design is also advantageous for a so-called retrofit, i.e. the modernization and/or retrofitting of an existing system. For example, the compact design makes it possible to replace pneumatic pumps that are less favourable in terms of energy consumption, as the pumps can then be replaced without major conversion work.

The electric drive device is particularly advantageous in the form of a torque motor. A torque motor is understood to be a preferably high-pole, direct electric drive. Torque motors generally have very high torques at relatively low speeds. Put simply, a torque motor can be regarded as a motor with a hollow shaft optimised for high torques. One advantage of a torque motor is its very low energy requirement.

In contrast to the prior art solution according to GB 572502 A, the torque motor makes it possible to convert the rotary movement into a linear movement within the motor. This results in a much more compact design.

Due to the design of the torque motor, a high torque required for a membrane stroke can also be achieved without a reduction gearbox. A torque motor has its rated point at a freely selectable lower speed. An asynchronous motor, on the other hand, requires a full magnetizing current even at low speeds in order to generate a rotor field. In a low speed range, which is required for membrane pumps, the asynchronous motor can therefore not be used without a gearbox for the double membrane pump application.

As an alternative to an electric torque motor, a pneumatically driven external rotor motor would also be conceivable, for example.

Furthermore, the torque motor makes it easy to realize the coaxial design of the rotor and piston rod. Regardless of whether a divided or undivided piston rod is provided, the membranes are coupled to the outer ends of the piston rod. The torque motor is thus located in an area between the membranes. This makes the design particularly compact and less bulky than, for example, drives arranged perpendicular to the piston rod.

In contrast to the double membrane pump known from WO 2021/202 689 A1, the direction of rotation can be changed without switching the motor by using a piston rod with guiding grooves instead of a spindle. Guide elements such as cams, balls or rollers engage in the guiding grooves and thus form a guiding groove control. Preferably, the guide elements return to their starting point after a full rotation. The guiding groove control eliminates the need to switch the direction of rotation of the motor and the motor can operate at a constant rotational speed.

As an alternative to a control system in which the guiding grooves are designed so that the guide elements reverse the stroke direction of the piston rod and membrane after a full revolution, it is also possible to provide one or more switchover points after less than one revolution, for example after 0.5 revolutions of the piston rod. Such a control is particularly suitable if the installation space available for the piston rod is so large that the piston rod itself can also have a relatively large diameter or circumference. A guiding groove guide with switchover points during a revolution has the advantage that the pitch of the guiding groove can be selected to be greater than with a guiding groove guide with switchover after each full revolution for the same membrane stroke. In addition, the pumping frequency increases while the motor speed remains the same.

The use of balls as guide elements is particularly favored. A piston rod with an inserted guiding groove and balls guided in it can also be referred to as a ball screw. In simple terms, a ball screw is a screw thread in which inserted balls transmit the force between the screw and nut. Both parts each have a helical groove with a semi-circular cross-section, which together form a helical tube filled with balls. The balls form the positive connection in the thread at right angles to the screw line. During a rotary movement between the screw and nut, the balls roll in their tube and convert the rotary movement caused by the motor into a linear movement. The rolling movement reduces the frictional resistance and therefore also the wear and the drive requirement.

The elimination of the change in direction of rotation and the associated braking and acceleration losses results in considerable energy savings.

Another particularly advantageous feature is that the guiding groove control can have several guiding grooves, for example four guiding grooves, rather than just one. In a guiding groove control system with four guiding grooves, a tilting moment caused by the drive is absorbed in four quadrants by the guiding groove guide or the piston rod. Due to the preferably evenly offset guiding groove tracks, for example four guiding groove tracks offset by 90° to each other, the start and end points of the guiding grooves are evenly distributed around the circumference. This prevents tilting moments, such as those that occur in the prior art known from GB 572 502 A, for example. The piston rod does not tilt or at least tilts less and the drive runs more smoothly. This reduces wear and saves energy.

Since there is no need for complex control of the direction of rotation, the torque motor can be operated with a commercially available frequency converter. For the desired flow rate of the double membrane pump according to the invention, only the desired speed needs to be specified for the claimed design.

The guiding groove guide has an annular design to ensure a simple structure. This means that it is closed over one circumference of the piston rod. For example, the guiding groove guide can be designed by introducing groove-like recesses into the piston rod and/or the inner cylinder sheath of the torque motor.

In a further embodiment of the double membrane pump according to the invention, several guiding grooves, for example two guiding grooves assigned to one membrane, are identically designed and arranged parallel to each other. The advantage is a lower surface pressure of guide elements designed to protrude into the guiding groove. In other words, this means that several guiding grooves, at least two of which are identical in shape, are arranged next to each other or one behind the other in the direction of movement, thus reducing the surface pressures.

In particular in a design with a split piston rod, at least two guiding grooves are formed to move one of the membranes in each case, with the two guiding grooves being arranged one behind the other on the piston rod as viewed in the axial direction of the piston rod. One guiding groove is thus used to control the movement of one membrane and the other guiding groove is used to control the movement of the other membrane. The two guiding grooves preferably have a rotational angular offset to each other. This allows the guide elements designed for guiding in the guiding groove to be spatially offset and form an exact guide for the piston rod over its entire circumference.

If the guiding groove guide has a guide element that is independent of the guiding groove, this is a simple way to improve the safe operation of the double membrane pump, as jamming is significantly reduced, in particular eliminated. The independently designed guide element is a guide element that can move freely in the backdrop. The guide elements, which engage in both the rotor and the piston rod and with the help of which the oscillating movement of the piston rod is brought about, are thus in operative connection with the rotor and the piston rod, but are not firmly connected to one of the two components, but are movable relative to both components.

The double membrane pump according to the invention is preferably safe to operate if the guide element is in the form of a ball, a roller or a pin. In particular, if the guide element is in the form of a ball, the rotational symmetry of the ball prevents it from tilting or getting stuck in the guiding groove. In order to compensate for dynamic loads and/or tolerances, the guide elements can also be spring-loaded.

In an advantageous further embodiment of the double membrane pump according to the invention, the guiding groove guide has a guide sleeve that is movably arranged on the piston rod and coupled to the torque motor, which is designed to accommodate the guide elements. In this way, the guide elements are held securely and movably in the guiding groove guide.

In symmetrically operating double membrane pumps, the suction stroke and pumping stroke alternate after equal periods of time. When the end positions of the membranes are reached, a reversal of direction is therefore necessary, which leads to a brief interruption in the flow rate. This phenomenon, known as pulsation, is usually minimized with the help of pulsation dampers. The disadvantage of using pulsation dampeners is that they represent an additional cost and make it more difficult to clean the pumps and delivery lines when changing materials or decommissioning the pumps. It is therefore advantageous to minimize the pulsation to such an extent that the use of pulsation dampers can be dispensed with and the double membrane pump has a delivery that is as uniform and uninterrupted as possible. This can be achieved, for example, in a corresponding design of the guiding grooves, thus with the help of corresponding guiding groove shapes and/or by a corresponding design of the piston rod.

In a further advantageous embodiment of the double membrane pump according to the invention, the guiding grooves are designed in such a way that a time span for a suction stroke is shorter than a time span for a delivery stroke. This makes it possible to minimize pulsation to such an extent that the use of pulsation dampers can be dispensed with and the double membrane pump has a delivery that is as uniform and uninterrupted as possible.

In a further advantageous embodiment of the double membrane pump according to the invention, the guiding grooves are designed in such a way that at a switchover point of one membrane, the opposite membrane is still in a delivery stroke and vice versa. The pumping strokes of the two membranes thus overlap. This means that there is never a time when one or the other membrane is not in pumping mode and the volume flow of the medium to be pumped drops to zero. This means that the pulsation can be further reduced.

It is also possible to reduce pulsation by, or in addition to the above-mentioned embodiments, the first membrane having a delivery profile that is different from a delivery profile of the second membrane. This can be easily achieved, for example, by using different materials for the membranes.

DETAILED DESCRIPTION OF PREFERRED EMBODIMENTS

Figure 1:
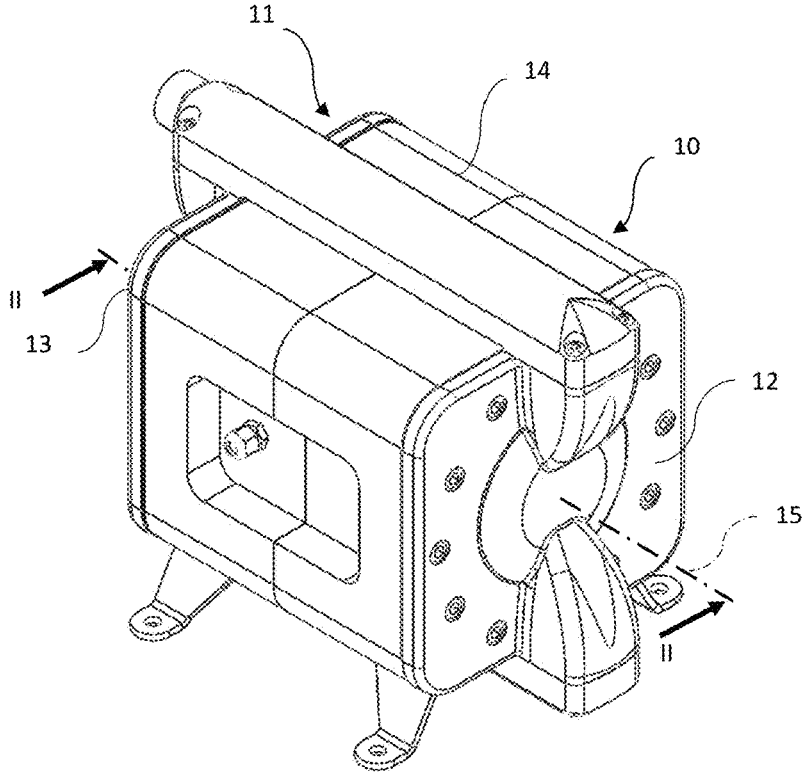
FIG. 1 shows a perspective view of a double membrane pump according to the invention in accordance with a first embodiment example.

Identical or similar elements may be provided with identical or similar reference signs in the figures. Furthermore, the figures in the drawing, their description and the claims contain numerous features in combination. A person skilled in the art will realise that these features can also be considered individually or that they can be combined to form further combinations not described in detail here. The invention also expressly extends to such embodiments which are not given by combinations of features from explicit references in the claims, which means that the disclosed features of the invention can be combined with one another as desired, insofar as this makes technical sense. The examples of embodiments shown in the figures are therefore only of a descriptive nature and are not intended to limit the invention in any way.

Figure 2:
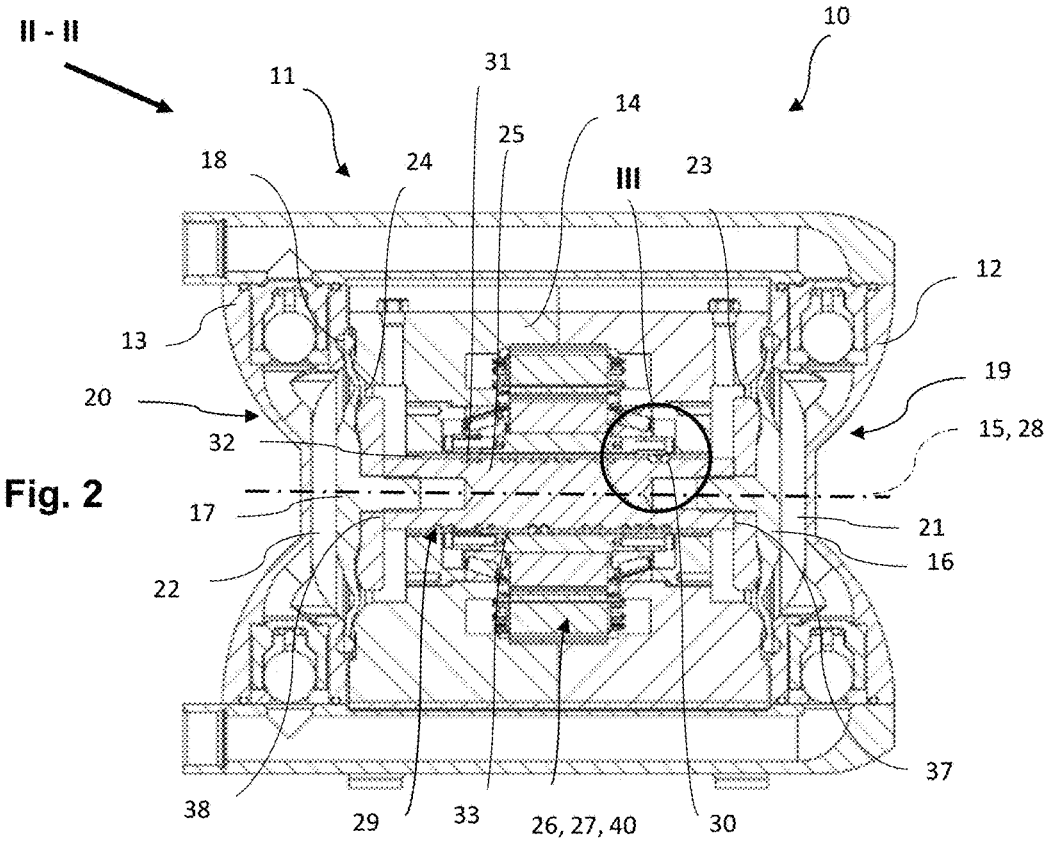
FIG. 2 shows a longitudinal section II-II of the double membrane pump according to FIG. 1.

A first embodiment example of a double membrane pump 10 according to the invention is illustrated in FIG. 1 in a perspective view and in FIG. 2 in a section II-II along a longitudinal axis 15 of the double membrane pump 10. At this point, it should be noted that the double membrane pump 10 according to the invention described here is not intended to be limited to the embodiments shown, but rather is transferable to any conceivable embodiment of a double membrane pump.

The double membrane pump 10 according to the invention essentially has a casing 11 with a pump body 14 arranged between a first casing cover 12 and a second casing cover 13. Furthermore, the double membrane pump 10 has two membranes as essential elements, namely a first membrane 16 and a second membrane 17. The membranes 16, 17 are compressed and held between the respective casing covers 12, 13 and the pump body 14 by means of a peripheral ring bead 18 formed on their circumference.

Elastomeric composite materials, such as NBR, are preferably used as materials for the membranes 16, 17. The NBR material assumes the function of an elastic base material onto which a chemically resistant, thin PTFE film can be laminated, particularly on the media side.

Together with the pump body 14, the casing covers 12, 13 form two chambers, a first chamber 19 and a second chamber 20, which are each divided by the membranes 16, 17 into a product chamber 21, 22 and an expansion chamber 23, 24 with alternating volumes. This means that the first chamber 19 is divided into the first product chamber 21 and the first expansion chamber 23 by means of the first membrane 16, and the second expansion chamber 24 is divided into the second product chamber 22 and the second expansion chamber 24 by means of the second membrane 17. In pneumatically driven double membrane pumps, the chambers 23, 24 serve as expansion chambers which, controlled by valves, are alternately pressurised with compressed air and thus realize a volume flow of a medium to be pumped.

The membranes 16, 17 are connected to a piston rod 25 at the rod ends 37, 38 in such a way that they alternately expand and compress the product chambers 21, 22. As is usual with pumps, a cycle is divided into a pumping stroke and a suction stroke.

During the pumping stroke, the membranes 16, 17 alternately press in the direction of the casing covers 12, 13 and displace the product or medium to be pumped from the product chambers 21, 22. During the suction stroke, the membranes 16; 17 are pulled towards the center of the pump body 14 by the piston rod 25, so that the product chambers 21, 22 are enlarged and a further amount of the medium is sucked in. In order to realize a uniform volume flow of the medium to be pumped, the double membrane pump 10 is designed in such a way that when one membrane 16 is pumping, the other membrane 17 is sucking and vice versa. The backflow of the medium when switching the chambers 19, 20 is prevented by suitable non-return valves, which are not shown in detail.

An electric drive device 26 in the form of a torque motor 40 is arranged between the membranes 16, 17. The drive device 26 in the form of the torque motor 40 enables a compact coaxial design of its rotor 27 and the piston rod 25, which is formed between the membranes 16, 17. In other words, this means that a cantilevered design, i.e. a design requiring a large amount of installation space, as is the case, for example, with drive motors arranged perpendicular to the piston rod 25 and thus perpendicular to a motion axis 28 of the membranes 16, 17, is no longer inevitable.

According to the invention, a self-regulated oscillating movement of the piston rod 25 is realized with the aid of a guiding groove guide 29, which is formed on the piston rod 25 in the embodiment example shown. It should be mentioned at this point that the oscillating movement of the piston rod 25 is not an oscillating movement, as is the case with the oscillating movement of the membranes 16, 17, but the oscillating movement of the piston rod 25 is to be understood as a translational back and forth movement of the piston rod.

For this purpose, guide elements 30 arranged in the rotor 27 of the drive device 26, or, as in the present embodiment example, in a guide sleeve 32 coupled to the rotor 27, engage in groove-like recesses in the piston rod 25. The groove-like recesses in the piston rod 25 thus form guiding grooves 31 of the guiding groove guide 29. In this design, two guides are arranged parallel to each other. They are independent of each other in that they do not cross each other.

In the present embodiment example, the guide elements 30 are in the form of ball elements or balls. The guide sleeve 32 comprises recesses for receiving the balls. In the assembled state, the balls protrude from the recesses of the guide sleeve 32 and into the guiding grooves 31 of the piston rod 25. The oscillating movement of the piston rod 25 required to drive the membranes 16, 17 is realized with the aid of the positive guide formed by the guiding groove guide 29. In other words, this means that the self-regulated, oscillating movement of the piston rod 25 is brought about with the aid of a guiding groove guide 29 comprising at least two guiding grooves 31 formed independently of one another.

The guiding groove guide 29 thus has a guide element 30 formed independently of the guiding groove 31. In particular, the guide element 30 is also designed independently of the drive device 26. It is thus freely movable in the guiding groove 31 in accordance with a guide form of the guiding groove 31.

Figure 3:
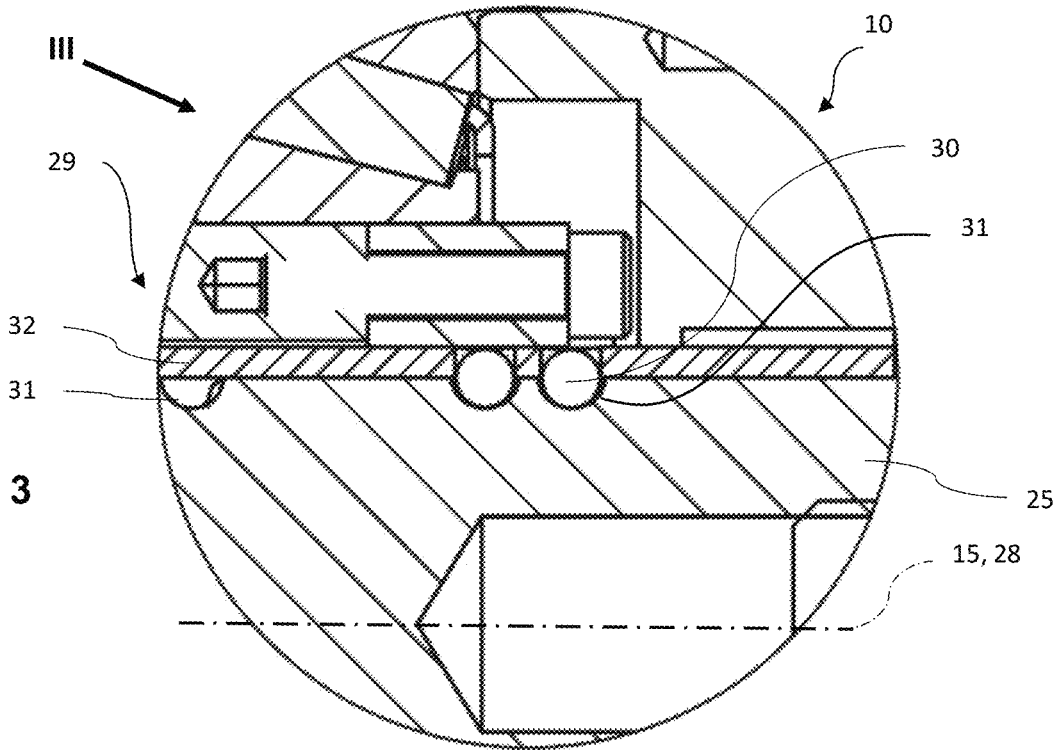
FIG. 3 shows a detailed view III of the double membrane pump according to FIG. 1.

FIG. 3 shows a sectional enlargement III, taken from FIG. 2, of the double membrane pump 10 according to the invention in accordance with the first embodiment example. The guide sleeve 32 forms a clearance fit with the piston rod 25. It can also be seen that two guide elements 30, here: balls, couple the guide sleeve 32 and the piston rod 25 to each other. Since the recesses in the guide sleeve 32 are circular bores for receiving the balls, the balls can rotate in the bores about their center with relatively little resistance, but cannot perform any translational movement relative to the guide sleeve 32. In contrast, the guiding grooves 31 in the piston rod 25 are channel-like guideways. When the guide sleeve 32 is rotated by means of the rotor 27, the rotational movement of the guide sleeve 32 is thus converted into a translational movement of the piston rod 25. The length of the stroke and the proportion of time for the suction stroke and pumping stroke depend on the design of the guiding groove 31 or can be determined by the design of the guiding groove 31.

Figure 4:
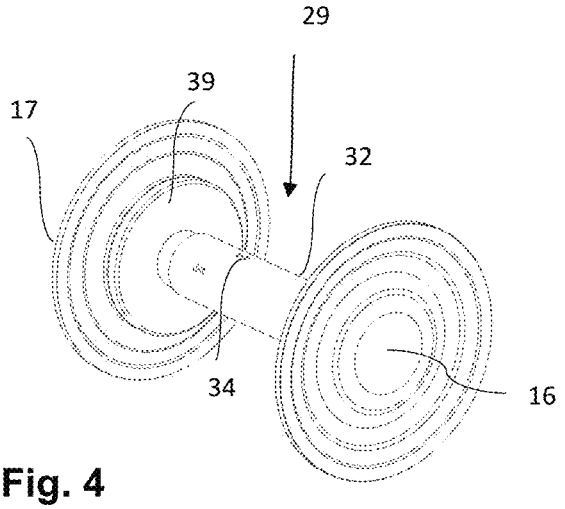
FIG. 4 shows a perspective view of a piston rod with a guide sleeve comprising two membranes of the double membrane pump according to the invention according to the first embodiment example.
Figure 5:
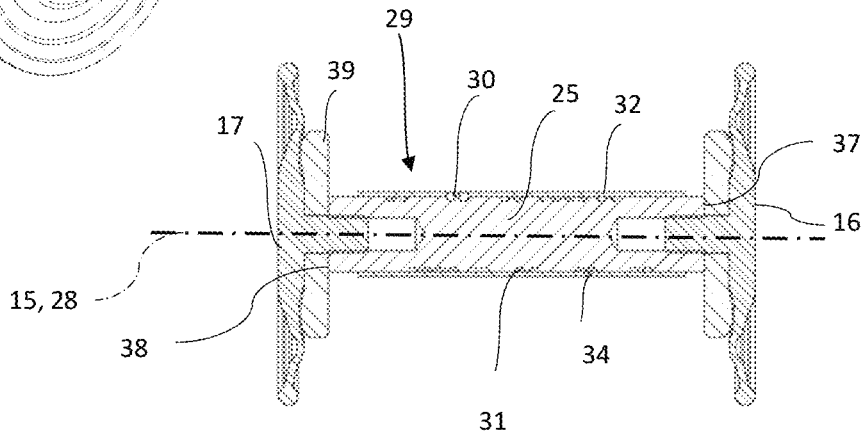
FIG. 5 shows a longitudinal section of the piston rod as shown in FIG. 4.

FIGS. 4 and 5 show the piston rod 25 surrounded by the guide sleeve 32 and together with the membranes 16 and 17 coupled to the piston rod 25. FIGS. 4 and 5 show the first embodiment example according to FIGS. 1 to 3 of the double membrane pump 10 according to the invention in a perspective view or in a longitudinal section. The guide sleeve 32 of the guiding groove guide 29 is movably arranged on the piston rod 25.

The guiding groove guide 29 comprises guiding grooves 31, which are designed in such a way that a reversal of the direction of rotation of the drive device 26 can be omitted. Complex control of the direction of rotation is therefore superfluous. This means that the double membrane pump 10 according to the invention is self-regulating. The drive device 26 in the form of the torque motor 40 can thus be operated with a commercially available frequency converter not shown in detail. For a desired flow rate of the double membrane pump 10 according to the invention, only a speed associated with the flow rate needs to be specified.

The guiding grooves 31 are each annular, i.e. they each form a closed annular groove extending over a circumference of the piston rod 25. At least one guide element 30 is arranged in each of these guiding grooves 31, which can move completely in the guiding groove 31 over its circumference. Or, in other words, each guide element 30 is fully movable in the guiding groove 31 over its circumferential extent. This leads to a safe mode of operation of the double membrane pump 10.

In the embodiment shown, the piston rod 25 according to the first embodiment example has two identical guiding grooves 31 arranged in pairs and parallel, next to each other. Due to the fact that in the present embodiment example two guiding grooves 31 are designed in pairs, the surface pressure caused by the guiding groove guide is reduced. In other words, to avoid wear of the piston rod 25 and the guide elements 30 due to high surface pressure, several guiding grooves 31 of identical shape are arranged next to each other, so that the surface pressure can be reduced. Of course, it is also possible to further reduce the surface pressure by adding one or more additional guiding grooves. An angular offset of the guiding grooves is also possible. This allows the forces to be distributed over the circumference.

The backdrops 31 arranged next to each other in pairs according to the first embodiment example enable a higher packing density in order to achieve the lowest possible surface pressure.

Figure 7:
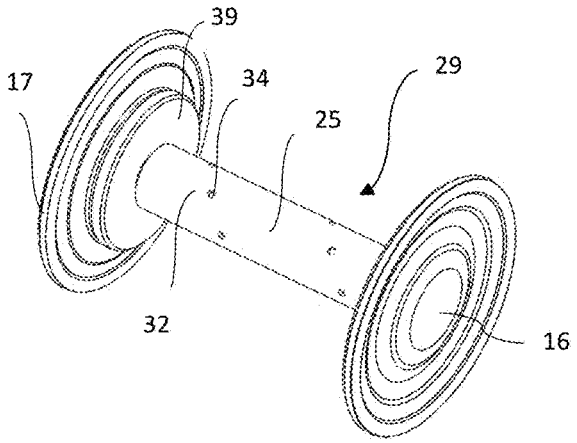
FIG. 7 shows a perspective view of the piston rod according to FIG. 6 with the guide sleeve.

Alternatively, the guiding grooves 31 are designed in such a way that all balls realize the same stroke-suction movement on the one hand, but are distributed evenly over the circumference of guide sleeve 32 and piston rod 25 on the other (see FIG. 7). The load caused by the guiding groove guide 29 is thus not transmitted from the guide sleeve 32 to the piston rod 25 on one side, i.e. along a single straight line parallel to the center axis of the piston rod 25, but is transmitted evenly, for example by four guide elements 30 or pairs of guide elements at four points or pairs of points at 90°, 180°, 270° and 360° from the guide sleeve 32 to the piston rod 25.

Figure 6:
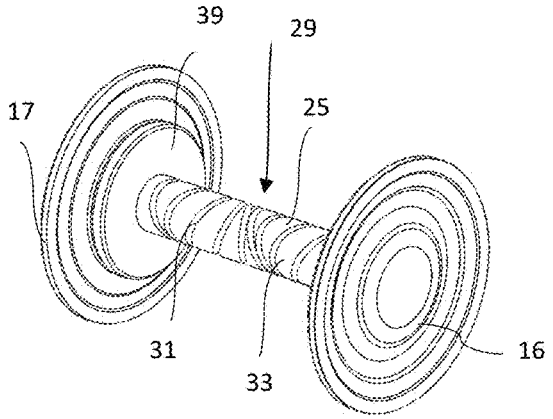
FIG. 6 shows a perspective view of the piston rod of the double membrane pump according to the invention in a second embodiment.
Figure 8:
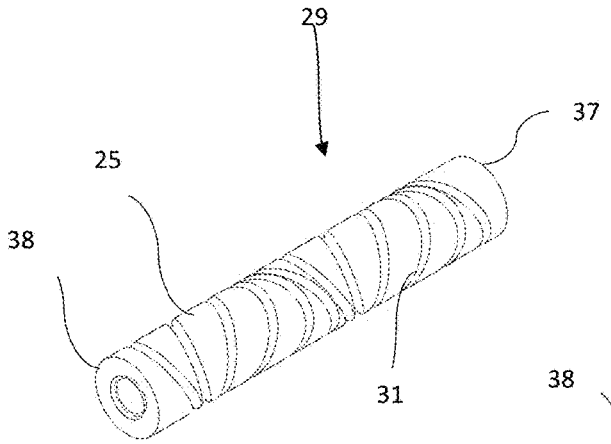
FIG. 8 shows a perspective view of the piston rod as shown in FIG. 6.
Figure 9:
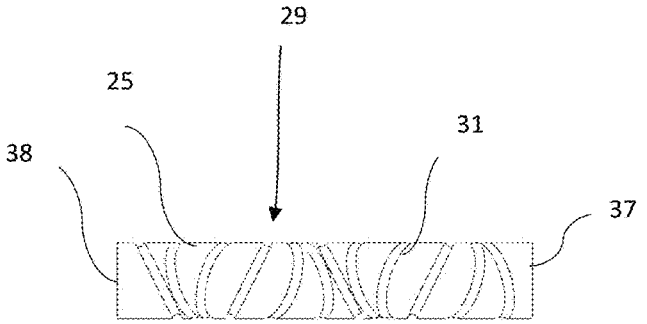
FIG. 9 shows a side view of the piston rod as shown in FIG. 6.

In FIGS. 6 to 9, the piston rod 25 according to the double membrane pump 10 according to the invention is illustrated in various views. FIG. 6 shows an embodiment example in a perspective view with the membranes 16, 17, but without guide sleeve 32. FIG. 7 shows the system according to FIG. 6 with mounted guide sleeve 32, in a further perspective view. FIGS. 8 and 9 show the piston rod 25 with the guiding grooves 31 inserted into the piston rod 25 in a perspective view, FIG. 9 shows the piston rod 25 according to FIG. 8 in a side view. In this second embodiment example, the guiding grooves 31 are arranged singly, i.e. not in pairs.

The guiding grooves 31 arranged next to each other according to the second embodiment example are arranged radially and axially offset from each other, as illustrated in particular in FIGS. 6, 8 and 9.

The number of guiding grooves 31, or pairs of guiding grooves, is basically dependent on the desired area of application of the double membrane pump 10 and its corresponding axial expansion.

By a selected rotational angular offset of the individual guiding grooves 31 or pairs of guiding grooves relative to one another, the guide elements 30 can be spatially offset and thus also form an exact, preferably ball-bearing mounted, guide of the piston rod 25 over its entire circumference. In other words, this means that at least two guiding grooves 31 are formed for moving the membrane 16, 17, wherein the two guiding grooves 31 are arranged next to each other on the piston rod 25, and wherein the two guiding grooves 31 have a rotational angular offset relative to each other.

The guide elements 30 are arranged movably in reception openings 34 of the guide sleeve 32 with the aid of the guide sleeve 32, which is designed to surround the piston rod 25 around its sheath surface 33.

Figure 10:
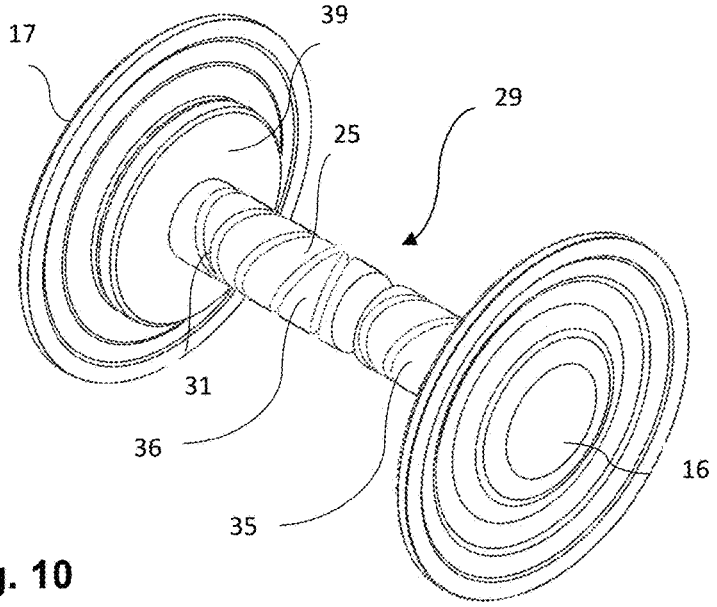
FIG. 10 shows a perspective view of a piston rod of the double membrane pump according to the invention according to a third embodiment example comprising the two membranes.
Figure 11:
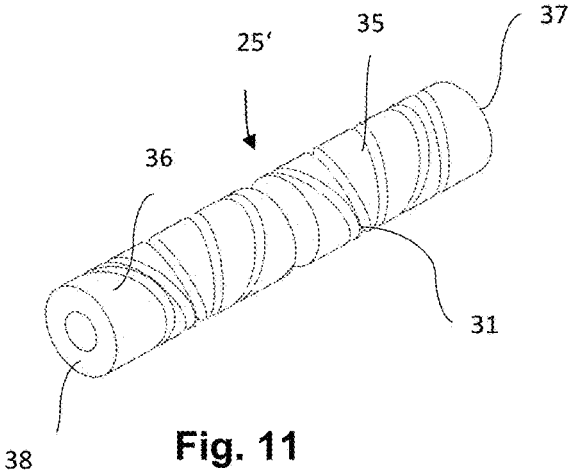
FIG. 11 shows a perspective view of the piston rod according to FIG. 10.
Figure 12:
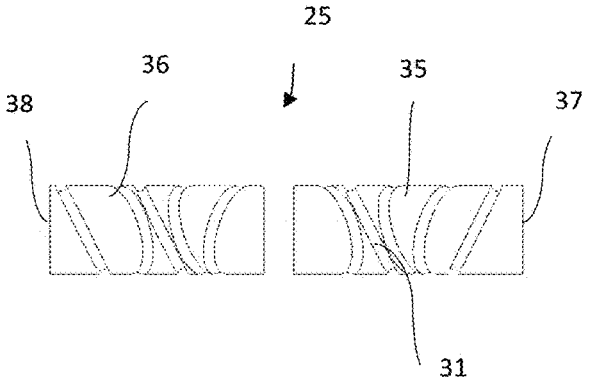
FIG. 12 shows a side view of the piston rod according to FIG. 11.

In a third embodiment example of the double membrane pump 10 according to the invention, the piston rod 25 is split. This split coupling rod 25 is illustrated in FIGS. 10 to 12, where it is illustrated in FIGS. 10 and 11 in a perspective view with the membranes 16, 17 or without these membranes 16, 17 and in FIG. 12 in a side view also without the membranes 16, 17.

Basically, in double membrane pumps 10, a flow of the medium or product to be conveyed is briefly interrupted due to the fact that when an end position of the membranes 16, 17 is reached and the direction of movement of the piston rod 25 is switched as a result. This results in so-called pulsation, which is usually minimized with the help of pulsation dampers. The disadvantage of using pulsation dampers is that they represent an additional cost and make it more difficult to clean the double membrane pumps 10 and the delivery lines (not shown in detail) when the material is changed or the double membrane pumps 10 are taken out of service.

The split piston rod 25 thus has a first piston rod section 35 and a second piston rod section 36, wherein the first piston rod section 35 has the first membrane 16 at its first rod end 37, which is formed facing away from the second piston rod section 36, and the second piston rod section 36 has the second membrane 17 at its second rod end 38, which is formed facing away from the first piston rod section 35. The two piston rod sections 35, 36 are preferably of the same dimensions.

In other words, this means that the piston rod 25 of the double membrane pump 10 according to the invention according to the second embodiment example is preferably interrupted in the center, and thus independent movements of the two membranes 16, 17 can be realized.

With the formation of at least two independent guiding grooves 31 in a respective piston rod section 35; 36, a movement of the membranes 16, 17 is realized in such a way that a time span required for a suction stroke of the membranes 16, 17 is shorter, preferably minimally shorter, than a time span for a delivery stroke. This results in a forced overlapping of the conveying strokes of the two membranes 16, 17.

The movement profiles are preferably designed in such a way that at the switchover point of the first membrane 16, at which there is no delivery of the medium, the second membrane 17 has not yet reached its switchover point and thus maintains the delivery of the double membrane pump 10. Conversely, the interruption of the delivery flow at the switchover point of the second membrane 17 is at least partially compensated for by the delivery of the first membrane 16.

This is possible because the time for the suction stroke is always shorter than the time for the delivery stroke due to the design of the guiding grooves 31 in the split piston rods 25, or in other words, in the two piston rod sections 35, 36. The pulsation phenomenon can thus be considerably reduced and the use of pulsation dampers can be dispensed with.

It should be mentioned at this point that both in double membrane pumps 10 with a continuous piston rod 25 and in double membrane pumps 10 with a split piston rod 25, a support disc 39 is assigned to each membrane 16, 17 so that the pressure exerted by the piston rod 25 on the membrane 16, 17 can be transmitted over a large area to the corresponding membrane 16, 17. If it were not provided, the pressure would be transmitted to the membrane 16; 17 at specific points or over a very small area.

Figure 13:
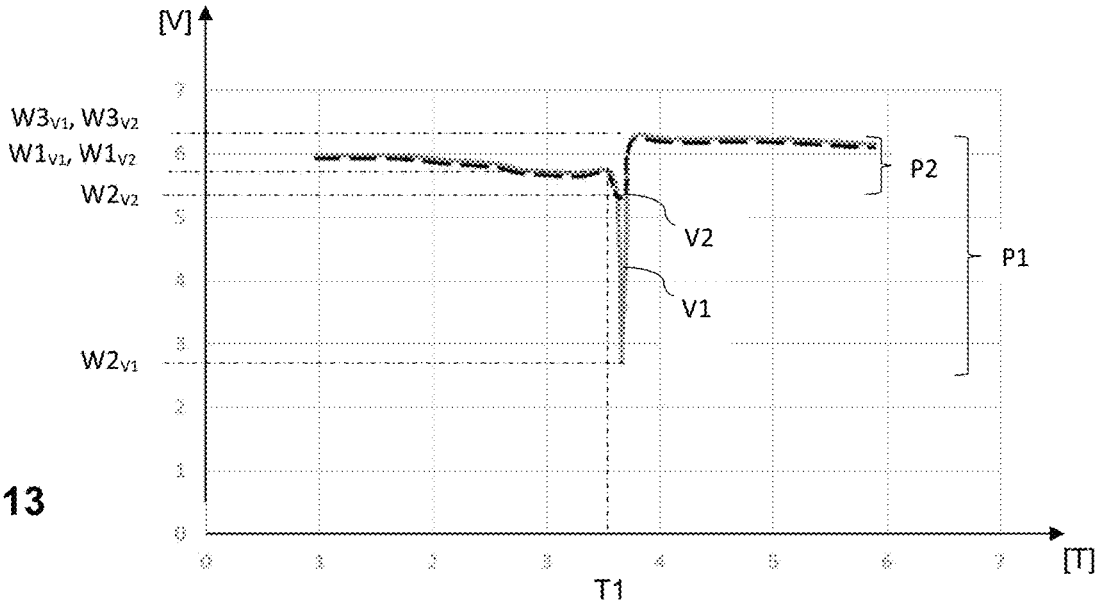
FIG. 13 shows in a time-volume flow diagram a volume flow curve of a double membrane pump according to the state of the art in comparison with a volume flow curve according to the third embodiment example.

In FIG. 13, a first volume flow curve V1 of a double membrane pump according to the prior art is shown in a time-volume flow diagram in comparison with a second volume flow curve V2 of the double membrane pump 10 according to the invention according to the third embodiment example. The second volume flow curve V2 is shown as a dashed line.

Both volume flow curves V1, V2 have an essentially identical curve before a switchover at a certain switchover time T1. A switchover always results in a reduction of a conveyed volume flow, which is why the first volume flow curve V1 drops from a first value W1V1 of the first volume flow curve V1 to a second value W2V1 of the first volume flow curve V1 and the second volume flow curve V2 drops from a first value W1V2 to a second value W2V2 of the second volume flow curve V2. It can be seen that the volume flow V1 (solid line) drops very sharply to the very low value W2V1 after the switchover. In contrast, the volume flow V2 (dashed line) of the double membrane pump 10 according to the invention drops much less sharply, namely only from the value W2V1 to the value W2V2.

After the switchover, the first value of the volume flow curve V1 increases to a third value W3V1, and the second value of the volume flow curve V2 increases to a third value W3V2, whereby the two third values W3V1, W3V2 are again identical, as are the first values W1V1, W1V2.

As the pump stroke progresses, both volume flow curves V1, V2 also reduce from the values W3V1 and W3V2 to the respective first values W1V1 and W1V2. This basic course of the volume flow curves V1, V2 is due to the elasticity of the membranes 16, 17 and lines. Pulsation is generally defined as a difference in the volume flow curve between the respective second value, i.e. the value achieved at the time of switching, and the third value during a so-called pump cycle. The first volume flow curve V1 therefore has a first pulsation P1 and the second volume flow curve V2 has a second pulsation P2. It is clearly recognizable that the second pulsation P2 is significantly lower than the first pulsation P1.

With the aid of the piston rod 25 according to the third embodiment example of the double membrane pump 10 according to the invention, in other words the split piston rod 25, it is possible to realize a short suction stroke, for example ⅖ of the time of a pumping cycle, and a longer pumping stroke, for example ⅗ of the time of a pumping cycle, for each membrane 16; 17. The different durations are realized by different pitches of the backdrops 31 formed in the piston rod sections 35, 36. Due to the more than 50% duration of a pumping stroke, it is possible for the pumping strokes of the two membranes 16, 17 to overlap. By overlapping the pumping strokes, it is possible to significantly reduce the pulsation, as shown by the course of the second volume flow curve V2 in comparison with the first volume flow curve V1.

LIST OF REFERENCE SIGNS

10 double membrane pump
11 casing
12 first casing cover
13 second casing cover
14 pump body (casing body)
15 longitudinal axis
16 first membrane
17 second membrane
18 ring bead
19 first chamber
20 second chamber
21 first product chamber
22 second product chamber
23 first expansion chamber
24 second expansion chamber
25 piston rod
26 drive device
27 rotor
28 motion axis
29 guiding groove guide
30 guide element
31 guiding groove
32 guide sleeve
33 sheath surface
34 reception opening
35 first piston rod section
36 second piston rod section
37 first rod end
38 second rod end
39 support disc
40 torque motor
II-II section (of FIG. 1)
III detail (of FIG. 2)
P1 first pulsation
P2 second pulsation
T time
T1 switchover time
V volume flow
V1 first volume flow
V2 second volume flow
W1V1 first value of the first volume flow curve
W1V2 first value of the second volume flow curve
W2V1 second value of the first volume flow curve
W2V2 second value of the second volume flow curve
W3V1 third value of the first volume flow curve
W3V2 third value of the second volume flow curve

What is claimed is:

1. A double membrane pump (10), comprising:

a casing (11) and a piston rod (25) received in the casing (11) for translational movement along a longitudinal axis (15) of the casing (11), wherein the casing (11) has at least one inlet opening and at least one outlet opening, and wherein a first membrane (16) of the double membrane pump (10) is arranged at a first rod end (37) of the piston rod (25) and a second membrane (17) of the double membrane pump (10) is arranged at a second rod end (38) of the piston rod (25) facing away from the first rod end (37), wherein the first membrane (16) is arranged in a first chamber (19) of the double membrane pump (10) formed in the casing (11) and the second membrane (17) is arranged in a second chamber (20) formed in the casing (11), wherein the membranes (16, 17) are designed to separate the chambers (19, 20) into a product chamber (21; 22) and an expansion chamber (23; 24) respectively, and with a drive device (26) for bringing about a translational movement of the piston rod (25), wherein the piston rod (25) is designed to perform a self-regulated, oscillating movement, wherein the piston rod (25) is divided and the self-regulated, oscillating movement of the piston rod (25) is brought about with the aid of a guiding groove guide (29) having at least two guiding grooves (31) which are designed independently of one another, one guiding groove (31) being designed to move the first membrane (16) and the other of the guiding grooves (31) being designed to move the second membrane (17), wherein at least two guiding grooves (31) are formed for moving the membranes (16; 17), wherein the at least two guiding grooves (31) are arranged next to each other on the piston rod (25), and wherein the at least two guiding grooves (31) have a rotational angular offset relative to each other.

2. The double membrane pump (10) according to claim 1, wherein the drive device (26) has a rotor (27) formed coaxially with the piston rod (25).

3. The double membrane pump (10) according to claim 1, wherein at least one of the at least two guiding grooves (31) is annular.

4. The double membrane pump (10) according to claim 1, wherein several of the guiding grooves (31) are identically designed and arranged parallel to one another.

5. The double membrane pump (10) according to claim 1, wherein the guiding groove guide (29) has a guide sleeve (32) arranged movably on the piston rod (25).

6. The double membrane pump (10) according to claim 1, wherein the guiding grooves (31) are designed in such a way that at a switchover point of a membrane (16; 17), the opposite membrane (17; 16) is still in a delivery stroke.

7. The double membrane pump (10) according to claim 1, wherein the guiding groove guide (29) has a guide element (30) formed independently of the at least two guiding grooves (31).

8. The double membrane pump (10) according to claim 7, wherein the guide element (30) is in the form of a ball, a roller or a pin.

9. A double membrane pump (10), comprising:

a casing (11) and a piston rod (25) received in the casing (11) for translational movement along a longitudinal axis (15) of the casing (11), wherein the casing (11) has at least one inlet opening and at least one outlet opening, and wherein a first membrane (16) of the double membrane pump (10) is arranged at a first rod end (37) of the piston rod (25) and a second membrane (17) of the double membrane pump (10) is arranged at a second rod end (38) of the piston rod (25) facing away from the first rod end (37), wherein the first membrane (16) is arranged in a first chamber (19) of the double membrane pump (10) formed in the casing (11) and the second membrane (17) is arranged in a second chamber (20) formed in the casing (11), wherein the membranes (16, 17) are designed to separate the chambers (19, 20) into a product chamber (21; 22) and an expansion chamber (23; 24) respectively, and with a drive device (26) for bringing about a translational movement of the piston rod (25), wherein the piston rod (25) is designed to perform a self-regulated, oscillating movement, wherein the piston rod (25) is divided and the self-regulated, oscillating movement of the piston rod (25) is brought about with the aid of a guiding groove guide (29) having at least two guiding grooves (31) which are designed independently of one another, one guiding groove (31) being designed to move the first membrane (16) and the other of the guiding grooves (31) being designed to move the second membrane (17), wherein the guiding grooves (31) are designed in such a way that a time span for a suction stroke is shorter than a time span for a delivery stroke.

10. The double membrane pump (10) according to claim 9, wherein the drive device (26) has a rotor (27) formed coaxially with the piston rod (25).

11. The double membrane pump (10) according to claim 9, wherein at least one of the at least two guiding grooves (31) is annular.

12. The double membrane pump (10) according to claim 9, wherein several of the guiding grooves (31) are identically designed and arranged parallel to one another.

13. The double membrane pump (10) according to claim 9, wherein the at least two guiding grooves (31) are arranged next to each other on the piston rod (25), and wherein the at least two guiding grooves (31) have a rotational angular offset relative to each other.

14. The double membrane pump (10) according to claim 9, wherein the guiding groove guide (29) has a guide sleeve (32) arranged movably on the piston rod (25).

15. The double membrane pump (10) according to claim 9, wherein the guiding grooves (31) are designed in such a way that at a switchover point of a membrane (16; 17), the opposite membrane (17; 16) is still in a delivery stroke.

16. The double membrane pump (10) according to claim 9, wherein the guiding groove guide (29) has a guide element (30) formed independently of the at least two guiding grooves (31).

17. The double membrane pump (10) according to claim 16, wherein the guide element (30) is in the form of a ball, a roller or a pin.

18. A double membrane pump (10), comprising:

a casing (11) and a piston rod (25) received in the casing (11) for translational movement along a longitudinal axis (15) of the casing (11), wherein the casing (11) has at least one inlet opening and at least one outlet opening, and wherein a first membrane (16) of the double membrane pump (10) is arranged at a first rod end (37) of the piston rod (25) and a second membrane (17) of the double membrane pump (10) is arranged at a second rod end (38) of the piston rod (25) facing away from the first rod end (37), wherein the first membrane (16) is arranged in a first chamber (19) of the double membrane pump (10) formed in the casing (11) and the second membrane (17) is arranged in a second chamber (20) formed in the casing (11), wherein the membranes (16, 17) are designed to separate the chambers (19, 20) into a product chamber (21; 22) and an expansion chamber (23; 24) respectively, and with a drive device (26) for bringing about a translational movement of the piston rod (25), wherein the piston rod (25) is designed to perform a self-regulated, oscillating movement, wherein the piston rod (25) is divided and the self-regulated, oscillating movement of the piston rod (25) is brought about with the aid of a guiding groove guide (29) having at least two guiding grooves (31) which are designed independently of one another, one guiding groove (31) being designed to move the first membrane (16) and the other of the guiding grooves (31) being designed to move the second membrane (17), wherein the first membrane (16) has a delivery profile which is different from a delivery profile of the second membrane (17).

19. The double membrane pump (10) according to claim 18, wherein the drive device (26) has a rotor (27) formed coaxially with the piston rod (25).

20. The double membrane pump (10) according to claim 18, wherein at least one of the at least two guiding grooves (31) is annular.

21. The double membrane pump (10) according to claim 18, wherein several of the guiding grooves (31) are identically designed and arranged parallel to one another.

22. The double membrane pump (10) according to claim 18, wherein the at least two guiding grooves (31) are arranged next to each other on the piston rod (25), and wherein the at least two guiding grooves (31) have a rotational angular offset relative to each other.

23. The double membrane pump (10) according to claim 18, wherein the guiding groove guide (29) has a guide sleeve (32) arranged movably on the piston rod (25).

24. The double membrane pump (10) according to claim 18, wherein the guiding grooves (31) are designed in such a way that at a switchover point of a membrane (16; 17), the opposite membrane (17; 16) is still in a delivery stroke.

25. The double membrane pump (10) according to claim 18, wherein the guiding groove guide (29) has a guide element (30) formed independently of the at least two guiding grooves (31).

26. The double membrane pump (10) according to claim 25, wherein the guide element (30) is in the form of a ball, a roller or a pin.

* * * * *